US008069517B1

(12) United States Patent
Bush et al.

(10) Patent No.: US 8,069,517 B1
(45) Date of Patent: Dec. 6, 2011

(54) COMBINATION PORTABLE DIAPER CHANGER AND DISPOSABLE BAG DISPENSER

(75) Inventors: Mary Jean Bush, Santa Rosa Beach, FL (US); Melissa De La Vega, Tegucigalpa (HN); Lawrence O. Freese, Santa Rosa Beach, FL (US)

(73) Assignee: BRICA, Inc., Charlotte, NC (US)

( * ) Notice: Subject to any disclaimer, the term of this patent is extended or adjusted under 35 U.S.C. 154(b) by 0 days.

(21) Appl. No.: 12/750,960

(22) Filed: Mar. 31, 2010

Related U.S. Application Data

(60) Provisional application No. 61/165,539, filed on Apr. 1, 2009.

(51) Int. Cl.
*A47D 5/00* (2006.01)

(52) U.S. Cl. ..... 5/655; 5/484; 5/487

(58) Field of Classification Search ..... 5/655, 657, 5/947, 484, 487
See application file for complete search history.

(56) References Cited

U.S. PATENT DOCUMENTS 7,062,807 B2 * 6/2006 Conforti ..... 5/655
2007/0214573 A1 * 9/2007 Soloway ..... 5/655

OTHER PUBLICATIONS

Munchkin Designer Diaper Change Kit web page, http://www.munchkin.com/products/detail.html?section=prodCategories&ID=10008&pID=1447, date unknown.
Munchkin Diaper Bag Dispenser web page, http://www.munchkin.com/products/detail.html?section=prodCategories&ID=10002&pID=1280, date unknown.
Munchkin Diaper Change Organizer web page, http://www.munchkin.com/products/detail.html?section=prodCategories&ID=10002&pID=214, date unknown.
Munchkin Fold 'N Go Diaper Changer web page, http://www.munchkin.com/products/detail.html?section=prodCategories&ID=10002&pID=206, date unknown.

* cited by examiner

*Primary Examiner* — Fredrick Conley
(74) *Attorney, Agent, or Firm* — Carter & Schnedler, P.A.

(57) ABSTRACT

A combination diaper changer and dispenser is provided, particularly for "on-the-go" diapering. A generally trifold structure of sheet material has an inside surface side and an outside surface side, and includes an intermediate panel serving as a rear cover when the structure is folded, a first end panel serving as a front cover when the structure is folded, and a second end panel serving as a diaper changing surface when unfolded. A bag dispenser compartment is secured to the intermediate panel on the inside surface side. The dispenser compartment includes a dispensing aperture for withdrawing bags.

11 Claims, 7 Drawing Sheets

COMBINATION PORTABLE DIAPER CHANGER AND DISPOSABLE BAG DISPENSER

CROSS-REFERENCE TO RELATED APPLICATION

The benefit of U.S. provisional patent application Ser. No. 61/165,539, filed Apr. 1, 2009, is claimed.

BACKGROUND OF THE INVENTION

The invention relates generally to diaper changers and organizers, particularly for "on-the-go" diapering.

SUMMARY OF THE INVENTION

A combination diaper changer and dispenser is provided, including a generally trifold structure of sheet material having an inside surface side and an outside surface side. The generally trifold structure in turn includes an intermediate panel serving as a rear cover when the structure is folded, a first end panel serving as a front cover when the structure is folded, and a second end panel serving as a diaper changing surface when unfolded. A bag dispenser compartment is secured to the intermediate panel on the inside surface side, and includes a dispensing aperture for withdrawing bags.

DETAILED DESCRIPTION

Figure 1:
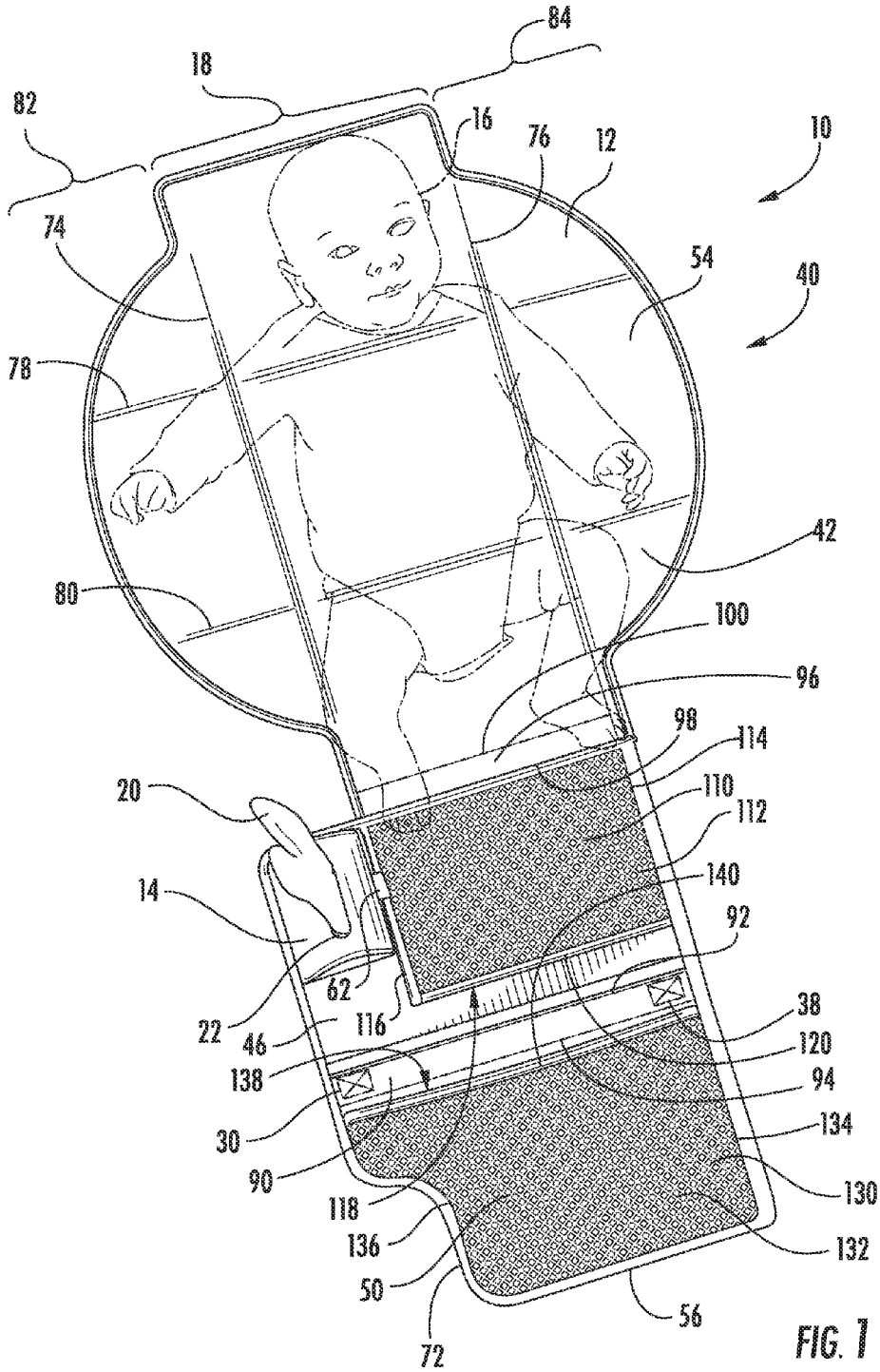
FIG. 1 illustrates a combination portable diaper changer and disposable bag dispenser embodying the invention unfolded and in use.
Figure 2:
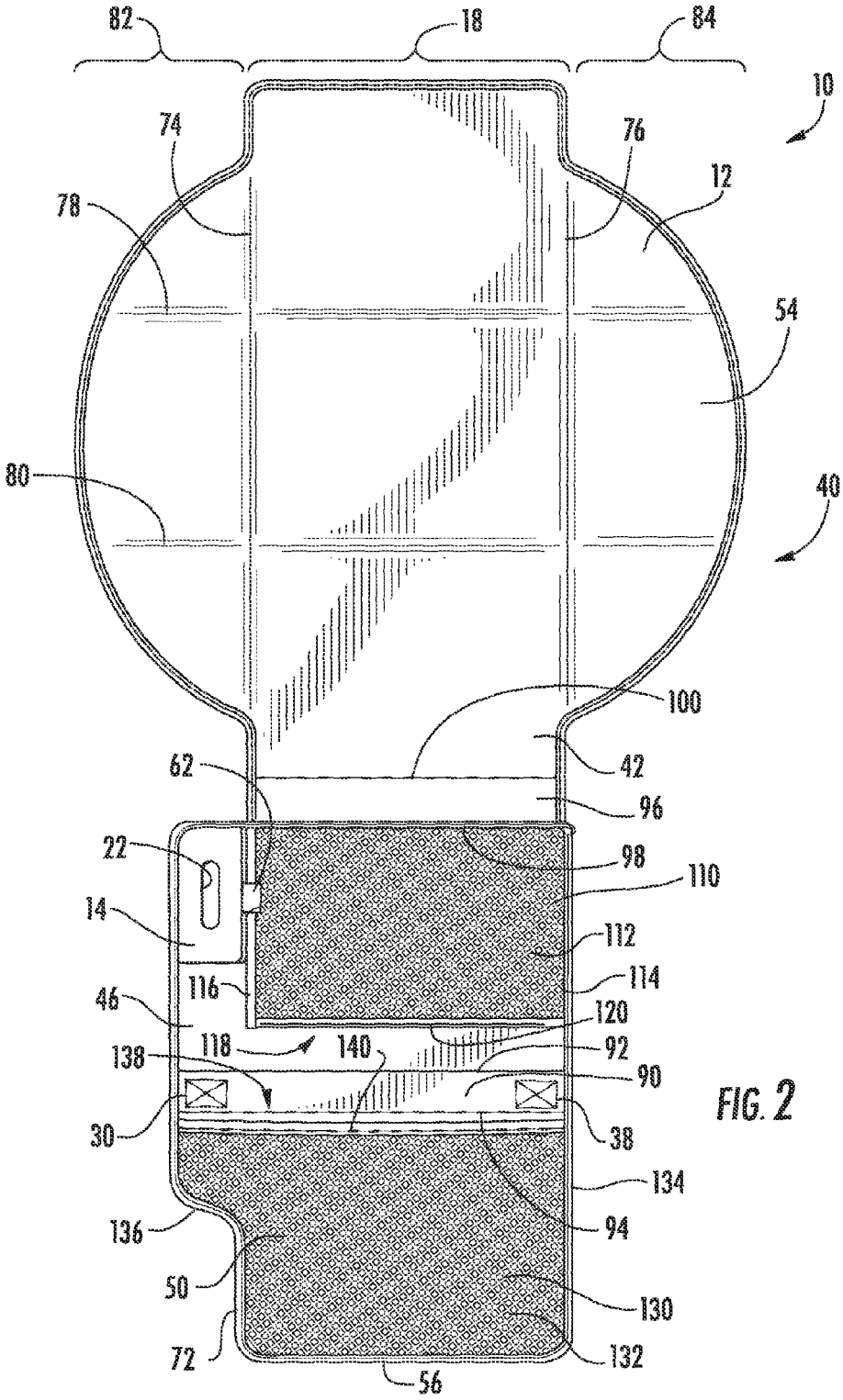
FIG. 2 is a top plan view of the combination changer and disposer of FIG. 1 when unfolded.
Figure 3:
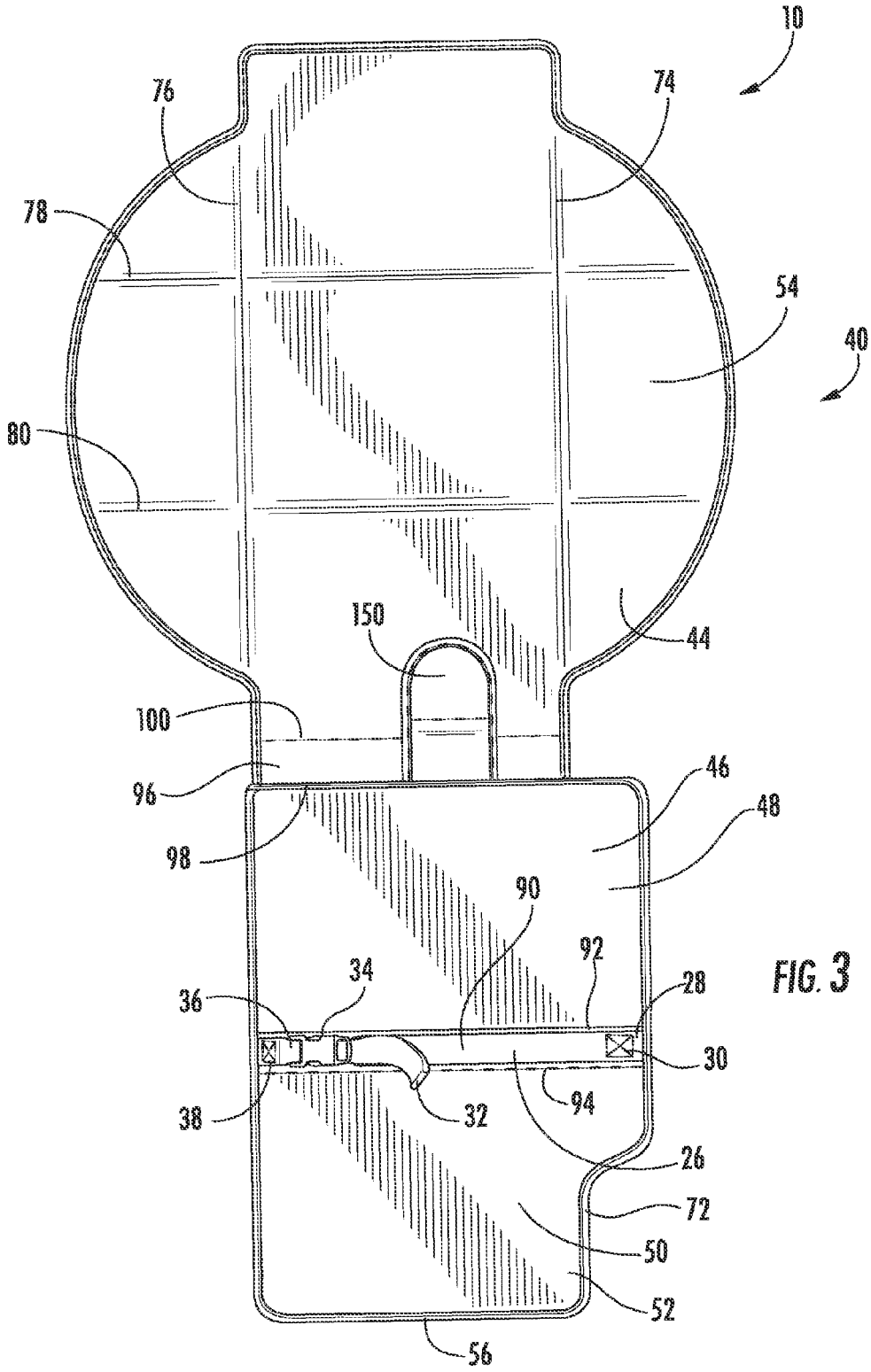
FIG. 3 is an underside view of the combination changer and dispenser when unfolded.

Referring initially to FIGS. 1-3, a combination diaper changer and dispenser 10 embodying the invention, among other features, combines a diaper changing surface 12, which is at least partially padded, and a bag dispenser compartment 14 which in the illustrated embodiment receives and stores disposable plastic diaper bags in tear-off roll form. In the in-use view of FIG. 1, a baby 16 is illustrated on the diaper changing surface 12, primarily on a padded intermediate portion 18 of the diaper changing surface 12. A portion 20 of a disposable bag is shown in FIG. 1 projecting through a slotted dispensing aperture 22 in the bag dispenser compartment 14.

Figure 4:
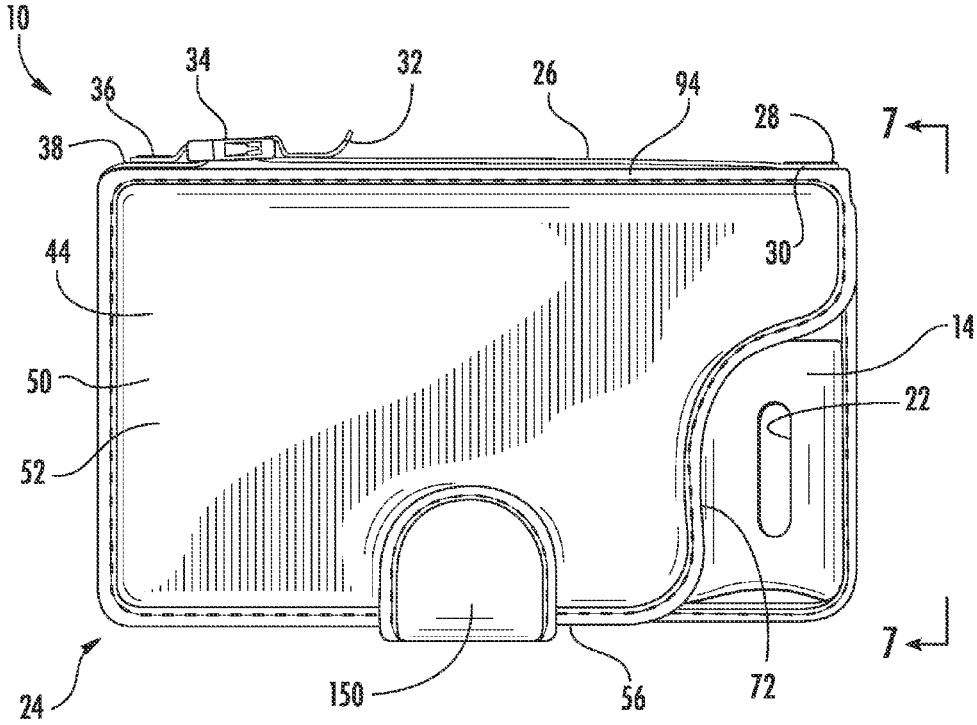
FIG. 4 is a top plan view of the combination portable diaper changer and disposable bag dispenser embodying the invention, in its configuration when completely folded up for carrying.
Figure 5:
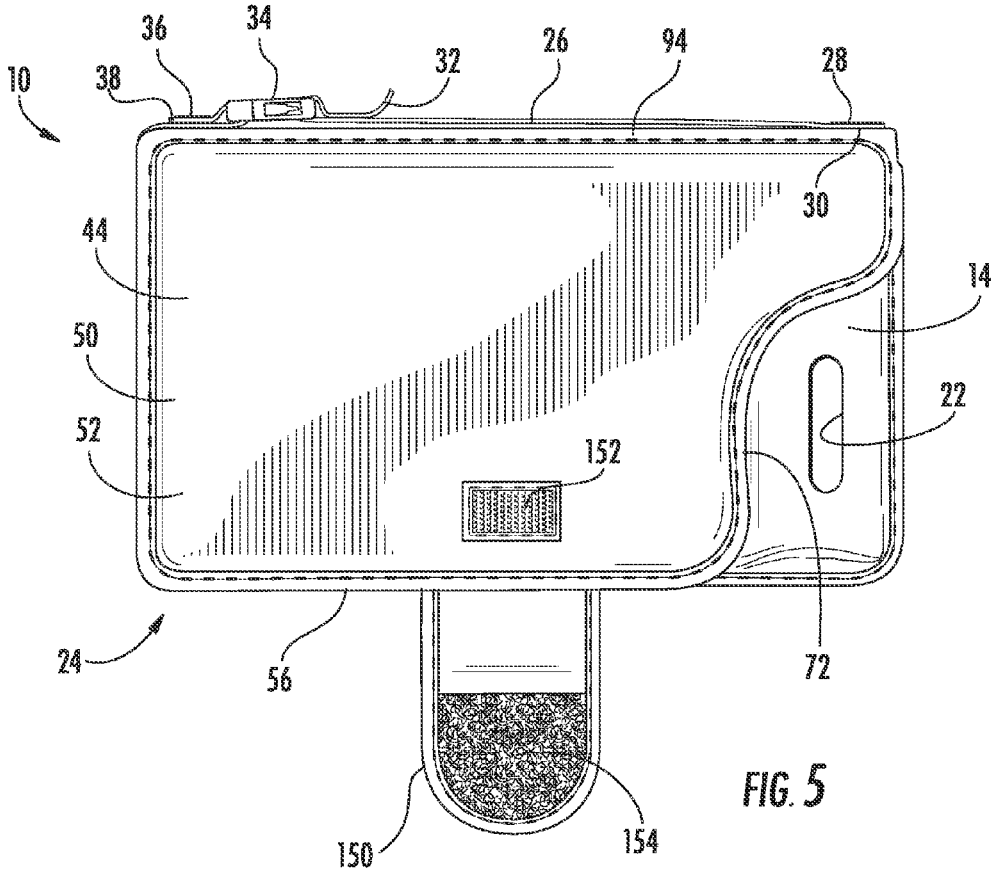
FIG. 5 is a view similar to that of FIG. 4, but with the fastener flap open.
Figure 7:
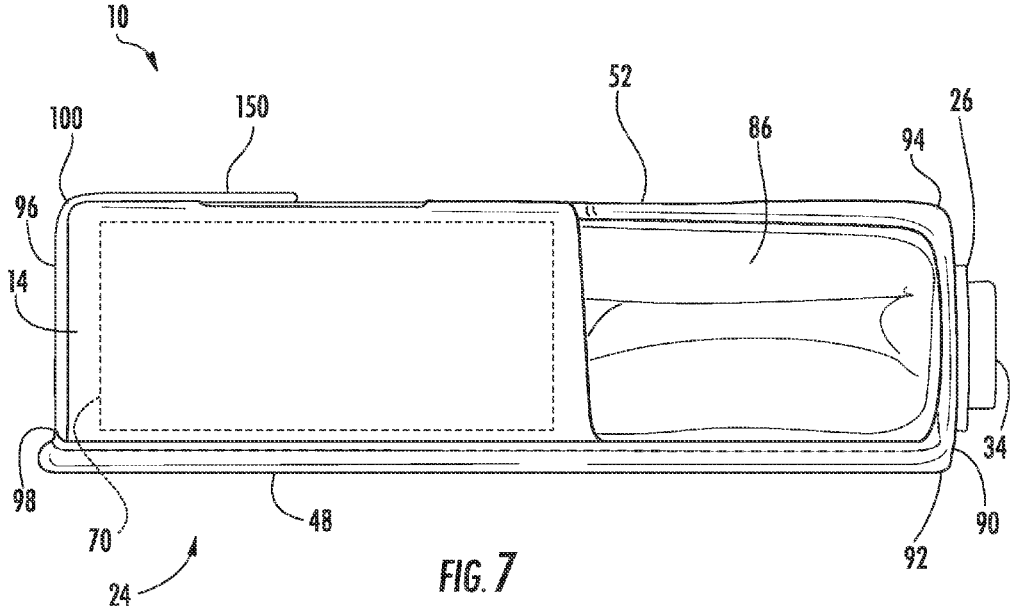
FIG. 7 is a side elevational view taken on line 7-7 of FIG. 4.

As illustrated in FIGS. 4, 5 and 7, when not in use, the combination changer and dispenser 10 folds into a case-like folded configuration 24 for easy portability. In the folded configuration 24 of FIGS. 4, 5 and 7, the combination changer and dispenser 10 is approximately twelve inches long, seven and one-half inches in width, and has a thickness of approximately two and one-quarter inches. A strap 26 is provided, secured at one end 28 by stitching 30 and cooperating at its distal end 32 with one element of a conventional a side-release plastic buckle 34. The other element of the buckle 34 is in turn connected to a short loop 36 of webbing secured by stitching 38. The strap 26 serves as a convenient carrying handle, and also can be employed to conveniently attach the combination changer and dispenser 10 to other structures, such as a stroller (not shown).

The combination changer and dispenser 10 more particularly includes a generally trifold structure 40 of sheet material having an inside surface side 42 (FIGS. 1, 2 and 6), and an outside surface side 44 (FIGS. 3, 4 and 5). In general, the outside surface side 44 is made of a durable woven nylon or polyester fabric, and is the primary surface visible in the case-like folded configuration 24 of FIGS. 4, 5 and 7. The inside surface side 42 is made of various surface materials, described hereinbelow in greater detail.

The generally trifold structure 40 of sheet material includes an intermediate panel 46 which serves as a rear cover 48 (FIGS. 3 and 7) when the structure 40 is folded into the case-like folded configuration 24, a first end panel 50 which serves as a front cover 52 (FIGS. 3, 4, 5 and 7) when the structure 40 is folded into the case-like folded configuration 24, and a second end panel 54 serving as the diaper changing surface 12 when unfolded (FIGS. 1 and 2). The first end panel 50 serving as the front cover 52 terminates at an end edge 56.

Figure 6:
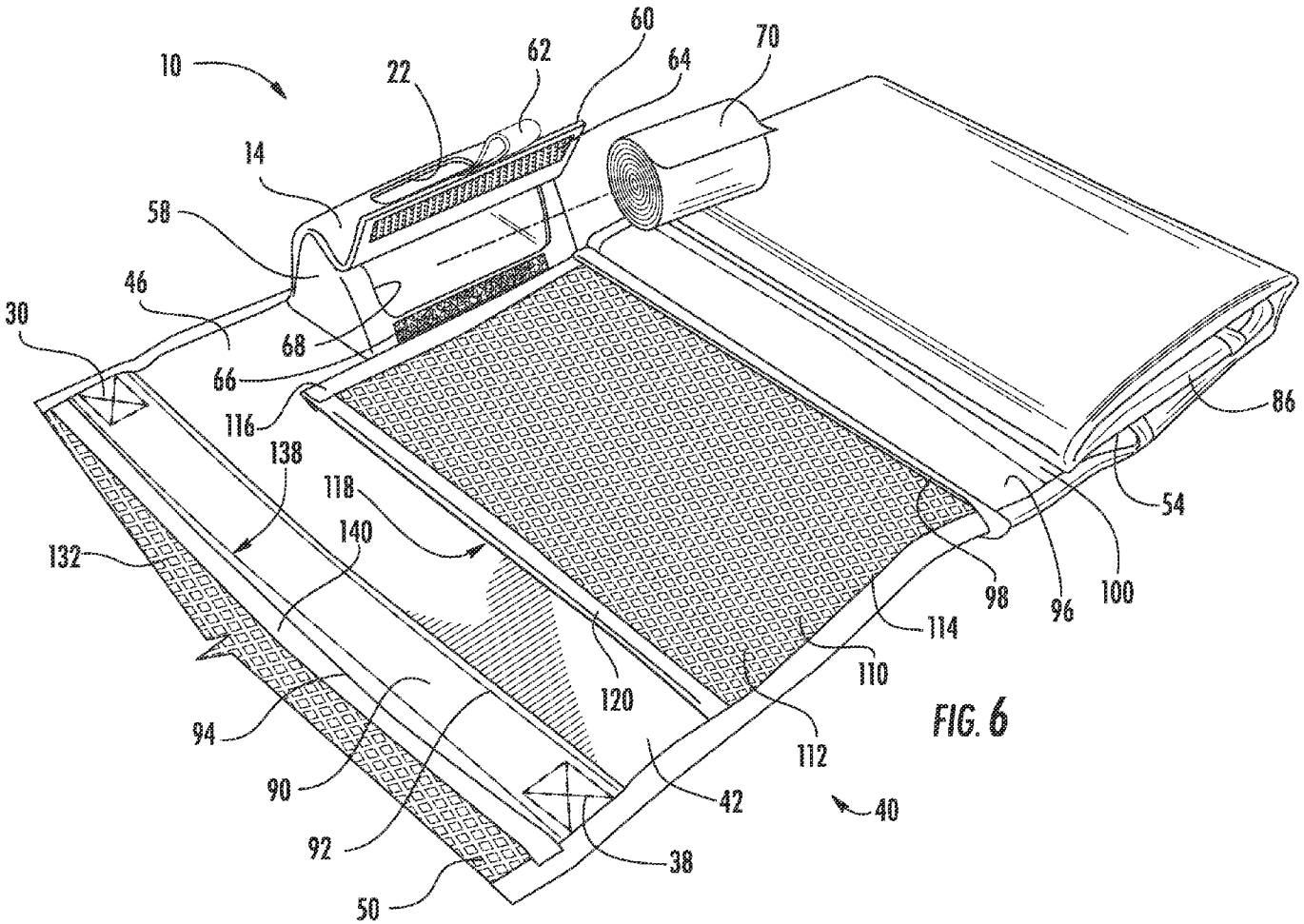
FIG. 6 is an enlarged three-dimensional view of a portion of the combination changer and dispenser, partially unfolded, illustrating in particular the disposable bag dispenser, as well as the changing pad when folded.

The bag dispenser compartment 14 is made of stiff fabric and is secured to the intermediate panel 46 on the inside surface side 42. With particular reference to FIG. 6, the bag dispenser compartment 14 includes a main body 58 and a closure flap 60 having a pull tab 62 and secured by hook 64 and loop 66 fastener elements. The main body 58 has sidewalls sewn to the intermediate panel 46 such that a portion of the intermediate panel 46 defines the bottom of the compartment 14. The closure flap 60 covers an opening 68 through which an exemplary roll 70 of disposable plastic diaper bags in tear-off roll form is inserted. Thus, the bag dispenser compartment 14 is configured to receive and store disposable plastic diaper bags, which are withdrawn through the slotted dispensing aperture 22, to be individually separated along perforations (not shown) in a conventional manner.

In an alternative embodiment (not shown), disposable plastic diaper bags are loaded as a "stack" of individual bags, rather than in tear-off roll form. In use, bags are pulled out through a slotted dispensing aperture in the same manner as conventional facial tissues (e.g. Kleenex( ) are dispenses from a box.

For convenient access to disposable plaster diaper bags in either the fully unfolded in-use configuration of FIG. 1, or the folded configuration of FIG. 4, the first end panel 50 which serves as the front cover 52 has a cutout 72, in the representative form of an arcuate cutout 72.

The second end panel 54 which serves as the diaper changing surface 12 more particularly is divided into nine sections by a pair of longitudinal fold lines 74 and 76 intersecting a pair of lateral fold lines 78 and 80. On the inside surface side 42, the surface of the second end panel 54 is vinyl for moisture resistance and easy cleanability. As described hereinabove, on the outside surface side 44, the surface of the second end panel 54 is a durable knit nylon or polyester fabric.

The padded intermediate portion 18 is defined between the longitudinal fold lines 74 and 76. Within the intermediate portion 18 padding is provided in the form of a layer of polyurethane foam material (not shown) between the vinyl diaper changing surface 12 on the inside surface side 42 and the fabric on the outside surface side 44. The layer of polyurethane foam has a thickness of for example ⅛ inch, and is secured by stitches which run along the fold lines 74, 76, 78 and 80. Thus, the longitudinal fold lines 74 and 76 define boundaries with unpadded side edge portions 82 and 84 of the changing surface 12 on either side of the padded intermediate portion 18.

To transition between the unfolded configuration of FIGS. 1-3 and the folded configuration of FIGS. 4, 5 and 7 subsequent to use of the combination changer and dispenser 10, the unpadded side edge portions 82 and 84 of the changing surface 12 are folded upwardly and inwardly (in the orientation of FIGS. 1 and 2) along the longitudinal fold lines 74 and 76. The partially folded changing surface 12 is next folded along the lateral fold line 80, again upwardly and inwardly, and finally along the lateral fold line 76 to form a folded changing pad 86, as illustrated in FIG. 6. The side elevational view of FIG. 7 shows a portion of the folded changing pad 86 recessed behind the bag dispenser compartment 14.

Particularly to accommodate the thickness of the folded changing pad 86, the generally trifold structure 40, in addition to the intermediate 46, first end 50 and second end 54 panels, includes a pair of spacer panels. More particularly, a first spacer panel 90 is provided between the intermediate panel 46 and the first end panel 50 and is joined to the panels 46 and 50 along respective fold lines 92 and 94. A second spacer panel 96 is provided between the intermediate panel 46 and the second end panel 54 and is joined to the panels 46 and 54 along respective fold lines 98 and 100. Thus, the structure 40 can conveniently be folded in a barrel fold configuration. The strap 26 more particularly is attached to the first spacer panel 90, on the outside surface side 44.

In addition to the bag dispenser compartment 14, the combination changer and dispenser 10 includes a pair of mesh storage pockets for storing a supply of clean diapers and a supply of wipes, as examples. More particularly, for diaper storage, an intermediate storage pocket 110 is provided, secured to the intermediate panel 46 on the inside surface side 42. The intermediate storage pocket 110 includes a mesh cover 112 sewn along the fold line 98, and along side stitching lines 114 and 116. The intermediate storage pocket 110 has an open end 118 defined by an elastic strip 120 sewn to the mesh cover 112.

Similarly, for storing other items, such as wipes, an end storage pocket 130 is provided, secured to the first end panel 50 on the inside surface side 42. The end storage pocket 130 includes a mesh cover 132 sewn along the edge 56 of the first end panel 50 serving as the front cover 52. The mesh cover 132 is additionally sewn along side stitching lines 134 and 136. The end storage pocket 130 has an open end 138 defined by an elastic strip 140 sewn to the mesh cover 132.

Finally, for holding the combination changer and dispenser 10 closed in its fully-folded configuration of FIGS. 4 and 7, a closure flap 150 is provided, generally on the outside surface side 44 of the trifold structure 40. In the illustrated embodiment, and as best seen in FIG. 3, the closure flap 150 is sewn along the fold line 98 connecting the second spacer panel 96 to the intermediate panel 46, and extends in a direction generally away from the intermediate panel 46 towards and partly over the second end panel 54. With particular reference to FIG. 5, a hook fastener element 152 is sewn to the first end panel 50 on the outside surface side 44 near the edge 56 of the first end panel 50 serving as the front cover 52. A corresponding loop fastener element 154 is secured to the closure flap 150.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A combination diaper changer and dispenser comprising:

a generally trifold structure of sheet material having an inside surface side and an outside surface side, said structure including an intermediate panel serving as a rear cover when said structure is folded, a first end panel serving as a front cover when said structure is folded, and a second end panel serving as a diaper changing surface when unfolded;

a bag dispenser compartment secured to said intermediate panel on said inside surface side, said dispenser compartment including a dispensing aperture for withdrawing bags; and said first end panel having a cutout which provides access to at least said dispensing aperture when said structure is folded.

2. A combination comprising:

a combination diaper changer and dispenser including a generally trifold structure of sheet material having an inside surface side and an outside surface side, said structure including an intermediate panel serving as a rear cover when said structure is folded, a first end panel serving as a front cover when said structure is folded, and a second end panel serving as a diaper changing surface when unfolded, and a disposable bag dispenser compartment secured to said intermediate panel on said inside surface side, said dispenser compartment including a dispensing aperture for withdrawing bags and said disposable bag dispenser compartment being configured to receive and store disposable plastic diaper bags in tear off roll form; and a roll of disposable plastic diaper bags in tear-off roll form received and stored within said disposable bag dispenser compartment.

3. The combination of claim 2, wherein said first end panel has a cutout which provides access to at least said dispensing aperture when said structure is folded.

4. A combination diaper changer and dispenser comprising:

a generally trifold structure of sheet material having an inside surface side and an outside surface side, said structure including an intermediate panel serving as a rear cover when said structure is folded, a first end panel serving as a front cover when said structure is folded, and a second end panel serving as a diaper changing surface when unfolded;

a bag dispenser compartment secured to said intermediate panel on said inside surface side, said dispenser compartment including a dispensing aperture for withdrawing bags; and said generally trifold structure of sheet material including a first spacer panel between said intermediate and first end panels and joined to said intermediate and first end panels along respective fold lines, and a second spacer panel between said intermediate and second end panels and joined to said intermediate and second end panels along respective fold lines, said first and second spacer panels serving to accommodate the thickness of said second end panel when said structure is folded in a barrel fold configuration.

5. The combination changer and dispenser of claim 4, which further comprises an intermediate storage pocket secured to said intermediate panel on said inside surface side.

6. The combination changer and dispenser of claim 5, which further comprises an end storage pocket secured to said first end panel on said inside surface side.

7. The combination changer and dispenser of claim 4, which further comprises an end storage pocket secured to said first end panel on said inside surface side.

8. The combination changer and dispenser of claim 4, which further comprises a closure flap for securing said intermediate panel to an end edge of said first end panel on said outside surface side.

9. The combination changer and disposer of claim 4, wherein at least a portion of said second end panel serving as a diaper changing surface when unfolded is padded.

10. The combination changer and dispenser of claim 4, wherein said second end panel is of greater extent than said intermediate and first end panels when unfolded, and separately folds to form a folded changing pad of extent similar to the extent of said intermediate and first end panels such that said folded changing pad fits in between said intermediate and first end panels when said generally trifold structure is folded in a barrel fold configuration.

11. The combination changer and dispenser of claim 4, which further comprises a closure flap for securing said intermediate panel to an end edge of said first end panel on said outside surface side.

* * * * *